United States Patent [19]

Ookubo

[11] Patent Number: 4,669,579

[45] Date of Patent: Jun. 2, 1987

[54] GROUP SUPERVISION APPARATUS FOR AN ELEVATOR

[75] Inventor: Syouichi Ookubo, Inazawa, Japan

[73] Assignee: Mitsubishi Denki Kabushiki Kaisha, Tokyo, Japan

[21] Appl. No.: 860,326

[22] Filed: May 6, 1986

[30] Foreign Application Priority Data

May 9, 1985 [JP] Japan ..... 60-98631

[51] Int. Cl.[4] ..... B66B 1/20

[52] U.S. Cl. ..... 187/124

[58] Field of Search ..... 187/29

[56] References Cited

U.S. PATENT DOCUMENTS 2,836,262 5/1958 Hockstein et al. ..... 187/29 R
3,610,370 10/1971 Suozzo et al. ..... 187/29 R
3,895,692 7/1975 Yeasting ..... 187/29 R
4,401,190 8/1983 Bittar ..... 187/29 R

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

In apparatus for dispersing cages and keeping them on standby during a period of light traffic, a memory device stores information as to a floor where the cage was dispersed and kept on standby in a preceding cycle of the period of light traffic, and a dispersive standby floor for a succeeding cycle is set different from the dispersive standby floor of the preceding cycle. Accordingly, the standby floor is automatically altered every dispersive standby cycle, and the dispersive standby floors can be prevented from being unevenly assigned.

7 Claims, 6 Drawing Figures

GROUP SUPERVISION APPARATUS FOR AN ELEVATOR

BACKGROUND OF THE INVENTION

This invention relates to a group supervision apparatus for an elevator wherein a plurality of cages are dispersed and kept on standby during a period of light traffic.

In a group supervision apparatus for an elevator, cages are dispersed to several floors in the whole building and kept on standby during a period of light traffic, so that hall calls which arise in the future can be responded to in short waiting periods of time. Dispersive standby operations by prior-art group supervision apparatuses for elevators include, for example, methods disclosed in Japanese Patent Application Laid-open No. 54-162357, Japanese Patent Application Laid-open No. 56-48375 and Japanese Patent Application Laid-open No. 59-48366.

Japanese Patent Application Laid-open No. 54-162357 discloses a method of operation wherein the numbers of occurrence of hall calls are counted for individual floors, and using statistics, dispersive standby floors are set to respective floors at which there are many users or on the basis of predicted large number of usage, or the number of cages to stand by at given floors may be determined. Japanese Patent Application Laid-open No. 56-48375 discloses a method of operation wherein a dispersive standby floor is set, and among a plurality of cages, one which is anticipated to reach the dispersive standby floor in the shortest period of time is given a dispersive standby command, whereby the dispersive arrangement of the cages can be promptly performed. In this case, the dispersive standby floor is artificially set at will. Japanese Patent Application Laid-open No. 59-48366 discloses a method of operation wherein a predetermined value is set between corresponding floors or between corresponding cages, and when an interval based on the positions of the cages has exceeded the predetermined value, the cages are moved so as to establish the interval of the set predetermined value, thereby to set dispersive standby floors. According to the prior-art group supervision apparatuses for elevators, cages are dispersed and kept on standby, and consideration is given so as to shorten the response times of the cages to hall calls to occur in the future, that is, the waiting times of users.

The prior-art group supervision apparatuses for elevators have the tendency that dispersive standby floors are fixed or are unevenly set to specified floors. This is inconvenient for some purposes of buildings. Especially in a building such as an apartment house or condominium, usually the dwellers of respective floors utilize the elevator equally. Therefore, in the case where the dispersive standby floors are fixed or biased to the specified floors, the apparent inequality that the service to the dwellers of those floors is better, whereas service to the dwellers of the other floors is worse, takes place and creates a problem.

As regards the apparatus which statistically sets the dispersive standby floors according to the degrees of use, special hardware and software for collecting the statistics of past use are required and make it expensive to realize the installation of the apparatus.

SUMMARY OF THE INVENTION

This invention has the objective to solve the problems as stated above, and has for its main object to provide a group supervision apparatus for an elevator by which a dispersive standby floor to be set during a period of light traffic can be prevented from becoming fixed or unevenly assigned. Another object is to provide such an apparatus which can be manufactured inexpensively.

In dispersing cages and keeping them on standby during a period of light traffic, the group supervision apparatus for an elevator according to this invention stores the dispersive standby floor of the cage in a preceding cycle of the period of light traffic and sets the dispersive standby floor in a succeeding cycle so as not to become the same floor as that in the preceding cycle.

In this invention, the dispersive standby floor to be set differs from the dispersive standby floor having been set in the preceding cycle, so that the dispersive standby floor is automatically altered every dispersive standby operation of the cage and is prevented from becoming fixed to a specified floor.

DESCRIPTION OF THE PREFERRED EMBODIMENT

An embodiment of this invention will now be described with reference to the drawings.

Figure 1:
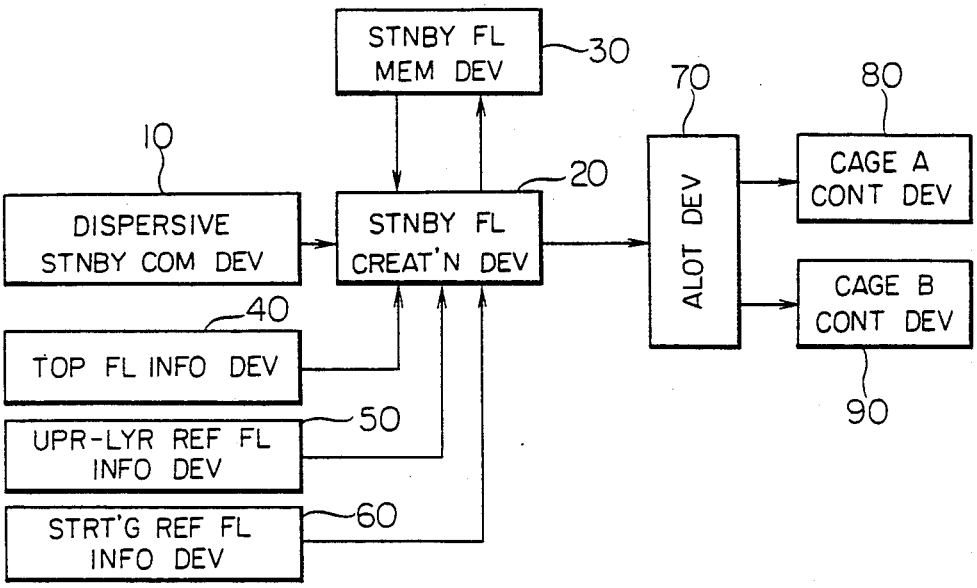
FIG. 1 is a block diagram of a group supervision apparatus for an elevator showing an embodiment of this invention.
Figure 4:
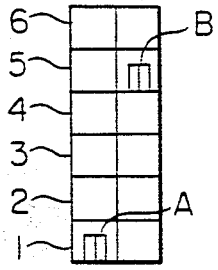
Figure 5:
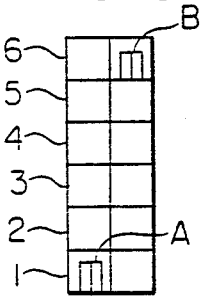
Figure 6:
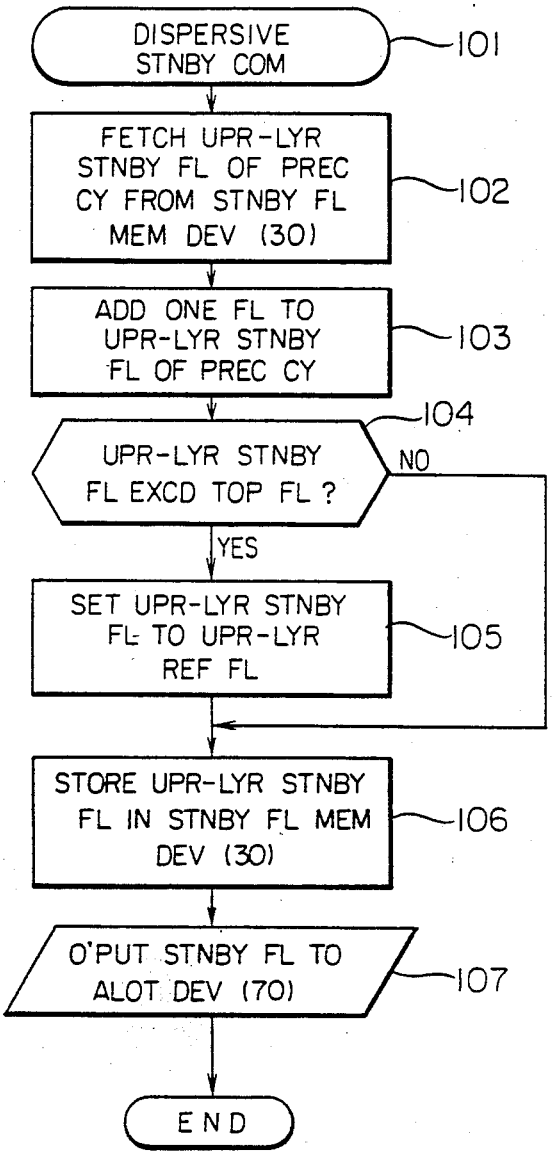
FIG. 6 is a flow chart for explaining the operation of the apparatus.

FIG. 1 is a block diagram showing the construction of a group supervision apparatus for an elevator according to this invention, FIGS. 2 to 5 are arrangement diagrams of cages in a building, and FIG. 6 is a flow chart showing the operation of the apparatus. There will be explained an example in which the group supervision apparatus for an elevator is applied to a 6-storeyed building, and numerals 1–6 indicated in FIGS. 2–5 signify first–sixth floors, respectively Referring to FIG. 1, numeral 10 designates a dispersive standby command device which outputs a dispersive standby command during a period of light traffic, numeral 20 a standby floor creation device which calculates and creates a dispersive standby floor, and numeral 30 a standby floor memory device. The standby floor creation device 20 executes a calculation on the basis of the command from the dispersive standby command device 10, and the information of the standby floor obtained by the calculation is stored in the standby floor memory device 30 and is also supplied to an allotment device 70 at the succeeding state. A top floor information device 40 stores as data the top limit floor (sixth floor) of the standby floors, an upper-layer reference floor information device 50 stores as data an upper-layer reference floor (fourth floor) which serves as a reference when a cage is kept on standby on the upper layer of the building, and a starting reference floor information device 60 stores the principal entrance-and-exit floor (first floor) of the building. These data items are supplied to the standby floor creation device 20, and are read out and utilized for calculations as may be required. The allotment calculation device 70 allots the information of the standby floor obtained by the calculation of the standby floor creation device 20, to the control of a predetermined cage. Numeral 80 designates a control device for cage A, and numeral 90 a control device for a cage B. In this embodiment, the two cages A and B are disposed as shown in FIGS. 2 to 5.

Next, the operation of the group supervision apparatus for the elevator will be described in connection with FIG. 6.

Figure 2:
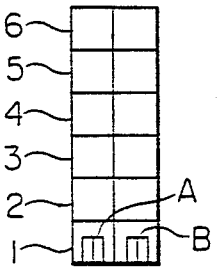
FIGS. 2 to 5 are arrangement diagrams of cages in a building.

First, it is assumed that both the cages A and B are on standby at the first floor as shown in FIG. 2 and that a state in which the elevator is not used, namely, a state of light traffic has continued for a predetermined time interval (for example, 5 minutes). Then, a dispersive standby command is output from the dispersive standby command device 10 to the standby floor creation device 20 (step 101). The standby floor creation device 20 having received the dispersive standby command creates a dispersive standby floor through steps to be described hereunder. Upon receiving the dispersive standby command, the creation device 20 fetches an upper-layer standby floor where the cage was dispersed and kept on standby in the preceding cycle of the period of light traffic (in this case, assumed the fourth floor), from the standby floor memory device 30 (step 102), and it adds one floor to the upper-layer standby floor of the preceding cycle (step 103). Subsequently, top floor information is fetched from the top floor information device 40, and it is compared with a floor obtained by the above addition (step 104). Since the top floor is not exceeded, the control flow proceeds to a step 106, at which the fifth floor obtained by the calculation of the step 103 is stored in the standby floor memory device 30 as the upper-layer standby floor of the current cycle. Thereafter, the upper-layer standby floor (fifth floor) created as stated above and a lower-layer standby floor (first floor) created by the use of another alogorithm and on the basis of starting reference floor information given from the starting reference floor information device 60 are output to the allotment device 70 (step 107). In this embodiment, the lower-layer standby floor is always fixed to the first floor which is the principal entrance-and-exit floor of the building. and it is not changed each time the dispersive standby command is issued.

The allotment device 70 having received the upper-layer standby floor (fifth floor) and the lower-layer standby floor (first floor) calculates which cages A and B are to be assigned to the upper-layer and lower-layer standby floors, and allots the upper-layer standby floor (fifth floor) to the cage B and the lower-layer standby floor (first floor) to the cage A. As a result, the cage-B control device 80 runs the cage B toward the fifth floor and stops the cage B upon arrival at the fifth floor so as to keep it on standby thereon. Since the cage A is at a stop on the first floor originally, the cage-A control device 90 holds the cage A standing by on the first floor.

In consequence of the above, the cage A and cage B are respectively dispersed and kept on standby on the first floor and fifth floor as shown in FIG. 4.

The elevator is thereafter used until the cages A and B come to stand by on the first floor again as shown in FIG. 2, whereupon the state of light traffic continues for the predetermined time interval. Then, an upper-layer standby floor and a lower-layer standby floor are created by the standby floor creation device 20 in the same way as in the foregoing. In the creation of the standby floors in this case, the upper-layer standby floor becomes the sixth floor because one floor is added to the aforementioned standby floor (fifth floor) at the step 103, and the lower-layer standby floor becomes the first floor as in the preceding cycle because it is fixed. As a result, the cage A and the cage B are respectively dispersed and kept on standby on the first floor and sixth floor as shown in FIG. 5.

Figure 3:
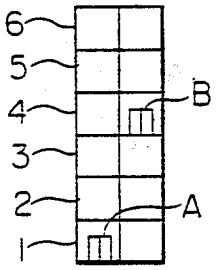

Subsequentlv, the elevator is used until the cages A and B come to stand by on the first floor again as shown in FIG. 2, whereupon the state of light traffic continues for the predetermined time interval. Then, an upper-layer standby floor and a lower-layer standby floor are created by the standby floor creation device 20 in the same way as in the foregoing. The upper-layer standby floor in this case has one floor added to the standby floor of the preceding cycle (sixth floor) at the step 103, and becomes the seventh floor. Since, however, the step 104 compares it with the top floor information (sixth floor) applied from the top floor information device 40 and decides it to exceed the latter, it is corrected by a step 105 to upper-layer reference information (fourth floor) applied from the upper-layer reference floor information device 50, and the upper-layer standby floor is set at the fourth floor. On the other hand, the lower-layer standby floor is the first floor because it is fixed. As a result, the cage A and the cage B are respectively dispersed and kept on standby on the first floor and fourth floor as shown in FIG. 3.

As thus far described, each time the state of light traffic occurs under which the dispersive standby command is issued from the dispersive standby command device 10, the upper-layer standby floor and the lower-layer standby floor are created. Especially the upper-layer standby floor is automatically altered every dispersive standby cycle, and the alteration is repeated at a fixed period. Accordingly, the upper-layer standby floor is not fixed or biased to a specified floor, and the dwellers of the respective floors are equally served by the elevator.

Although, in the above embodiment, the lower-layer standby floor is fixed, it can be varied likewise to the upper-layer standby floor.

A construction is also possible wherein the building is not divided into two, the upper layer and lower layer, but it is divided into three or more layers in accordance with the number of floors thereof or the number of installed cages so as to establish dispersive standby floors differing for the respective layers. The apparatus may well be so constructed as to form almost no divided layer and to set dispersive standby floors in any desired number.

Further, although the above embodiment adds the standby floor by one floor in succession, the standby floor may well be subtracted by one floor in succession, and a plurality of floors may well be added or subtracted. Besides, even when the dispersive standby floors are set by the use of ramdom numbers, a similar effect can be produced.

As described above, according to this invention, each time a dispersive standby state occurs, a dispersive standby floor is set so as not to become the same as that of a preceding cycle, so that the dispersive standby floors are not biased to a special floor, and equal services can be offered to the dwellers of the respective floors of a building. Another effect is that an apparatus can utilize a conventional memory device and dispenses with special hardware and can therefore be fabricated inexpensively.

What is claimed is:

1. In a group supervision apparatus for an elevator wherein a plurality of cages are supervised, and when the elevator is infrequently used, the respective cages are dispersed and kept on standby; a group supervision apparatus for an elevator comprising a standby floor memory device which stores a dispersive standby floor set each time a cage is dispersed and kept on standby, and a standby floor creation device which sets a different dispersive standby floor on the basis of the dispersive standby floor of a preceding cycle stored in said standby floor memory device, upon receiving a dispersive standby command.

2. A group supervision apparatus for an elevator as defined in claim 1 wherein the dispersive standby command is supplied by a dispersive standby command device which detects a state of use of the elevator and provides an output when an unused state of the elevator has continued for a predetermined time interval.

3. A group supervision apparatus for an elevator as defined in claim 1 wherein commands of the dispersive standby floors set by said standby floor creation device are supplied to an allotment device which generates allotment commands for allotting the dispersive standby commands to the predetermined cages respectively so as to run the cages to the corresponding standby floors.

4. A group supervision apparatus for an elevator as defined in claim 1 including wherein a first memory device which stores a preset number of reference standby floors, and said standby floor creation device receives information of the reference standby floor from said first memory device and sets the different dispersive standby floor on the basis of the information.

5. A group supervision apparatus for an elevator as defined in claim 4 wherein said standby floor creation device sets the different dispersive standby floor by adding or subtracting a predetermined floor number to or from a floor number of the reference standby floor.

6. A group supervision apparatus for an elevator as defined in claim 5 including a second memory device which stores information of a terminal one of floors to be served by the elevator, and said standby floor creation device decides whether or not a new dispersive standby floor evaluated by the addition or substraction exceeds the terminal floor, so that when the terminal floor is not exceeded, the evaluated dispersive standby floor is output as it is and that when it is exceeded, the reference standby floor stored in said first memory device is output as the different standby floor.

7. A group supervision apparatus for an elevator as defined in claim 6 wherein the standby floor memory device stores the dispersive standby floor calculated and output by said standby floor creation device, each time it is output.

* * * * *